US008310333B2

(12) United States Patent
Ventura et al.

(10) Patent No.: US 8,310,333 B2
(45) Date of Patent: Nov. 13, 2012

(54) MODULAR FUSE HOLDER

(75) Inventors: Joseph James Ventura, Eureka, MO (US); Matthew Rain Darr, Edwardsville, IL (US); Xuecheng Zhang, Changsha (CN)

(73) Assignee: Cooper Technologies Company, Houston, TX (US)

( * ) Notice: Subject to any disclaimer, the term of this patent is extended or adjusted under 35 U.S.C. 154(b) by 105 days.

(21) Appl. No.: 12/875,273

(22) Filed: Sep. 3, 2010

(65) Prior Publication Data

US 2012/0056708 A1 Mar. 8, 2012

(51) Int. Cl.
*H01H 85/46* (2006.01)
*H01H 85/48* (2006.01)
*H01H 71/20* (2006.01)

(52) U.S. Cl. ..... 337/211; 337/207; 337/208; 337/217; 337/187

(58) Field of Classification Search ..... 337/207, 337/211, 208, 187, 217
See application file for complete search history.

(56) References Cited

U.S. PATENT DOCUMENTS 3,194,926 A * 7/1965 Ustin ..... 337/215
3,406,365 A * 10/1968 Lameyre ..... 337/211
3,436,695 A * 4/1969 Dessert ..... 335/9
3,599,135 A * 8/1971 Gryctko ..... 337/236
3,614,697 A * 10/1971 Dunham et al. ..... 337/6
3,820,046 A * 6/1974 Layton et al. ..... 335/13
4,178,061 A * 12/1979 Ahroni ..... 439/620.29
4,514,723 A 4/1985 Leal
5,076,118 A * 12/1991 Lawson ..... 81/3.8
5,295,850 A 3/1994 Jeffcoat et al.
5,616,054 A * 4/1997 Quinlan ..... 439/620.26
5,969,587 A * 10/1999 Combas ..... 335/132
6,157,287 A * 12/2000 Douglass et al. ..... 337/198
6,710,270 B2 * 3/2004 Naimer ..... 200/50.02
6,717,505 B1 4/2004 Bruchmann
6,727,797 B1 * 4/2004 Bruchmann ..... 337/210
6,759,939 B2 * 7/2004 Sudan et al. ..... 337/211
6,794,979 B2 * 9/2004 Sudan et al. ..... 337/211
7,116,550 B2 10/2006 Ewing et al.
7,355,503 B2 * 4/2008 Buettner ..... 337/211
7,385,518 B2 6/2008 Torrez et al.
7,561,018 B2 * 7/2009 Buettner ..... 337/189
7,576,630 B2 8/2009 Darr
7,742,284 B2 * 6/2010 Ewing et al. ..... 361/623
8,134,828 B2 * 3/2012 Creighton et al. ..... 361/644
2002/0067240 A1 * 6/2002 Darr et al. ..... 337/187
2007/0063808 A1 * 3/2007 Darr et al. ..... 337/143
2008/0158788 A1 7/2008 Darr et al.
2010/0259355 A1 * 10/2010 Buettner et al. ..... 337/187

OTHER PUBLICATIONS

U.S. Appl. No. 12/691,344, filed Jan. 21, 2010.

* cited by examiner

*Primary Examiner* — Bradley Thomas
(74) *Attorney, Agent, or Firm* — Armstrong Teasdale LLP

(57) ABSTRACT

Modular fuse holder assemblies for configurable panelboards are specifically adapted to meet the needs of photovoltaic fuses and solar powered systems. Fuse rejection features, safety features, and remote monitoring features are further provided.

24 Claims, 8 Drawing Sheets

MODULAR FUSE HOLDER

BACKGROUND OF THE INVENTION

The field of the invention relates generally to overcurrent protection fuses, and more specifically, to modular fuse holders for overcurrent circuit protection.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

A variety of different types of fuse holders are known providing electrical interfaces for overcurrent protection fuses. Such fuse holders are typically wired into circuitry with line and load side terminals, and the fuses complete an electrical connection within the fuse holder between the line and load side terminals. Existing fuse holders, however, have not completely met the needs of those in the art, and improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

For power distribution purposes, fuses are sometimes arranged in and enclosed by a panelboard, sometimes referred to as a control panel. Other circuit protection components such as circuit breakers are also commonly used in combination with fuses in panelboards. A main service device connects a power supply to and from the panelboard, and the circuit breakers and fuses typically provide circuit protection to branch circuits being fed from the panel through the main disconnect. When the main service device is a disconnect switch it can be used to de-energize all the branch circuits, or the individual branch circuits can be de-energized using the circuit breakers while the main disconnect remains connected and the other branch circuits are still supplied with electrical power. Additionally, when electrical fault conditions occur, the circuit protectors (e.g., the breakers and the fuses) may be selectively coordinated so that only the affected branch circuit or feeder circuit may be interrupted while the other branch circuits and feeder circuits continue normal, full power operation.

Recently, panelboards have been developed use with compact fusible switching disconnect devices that provide both fuse capabilities and switching capabilities in a single housing. The compact package size of such devices eliminates a need for separately provided and separately wired circuit breakers common to conventional panelboard designs. This allows in a reduction in size of the panelboard, and a considerable increase in the interrupting rating per volume of the panelboard over conventional panelboards. An exemplary compact panelboard of this type, as well as the compact switching disconnect devices for the panelboard, are described in U.S. patent application Ser. Nos. 11/941,212 filed Nov. 16, 2007 and 12/691,344 filed Jan. 21, 2010, the disclosures of which are hereby incorporated by reference in their entirety. Further adaptations are desirable to configure the panelboards for particular uses, while still achieving further benefits of compact, space saving design with enhanced performance capabilities.

Figure 1:
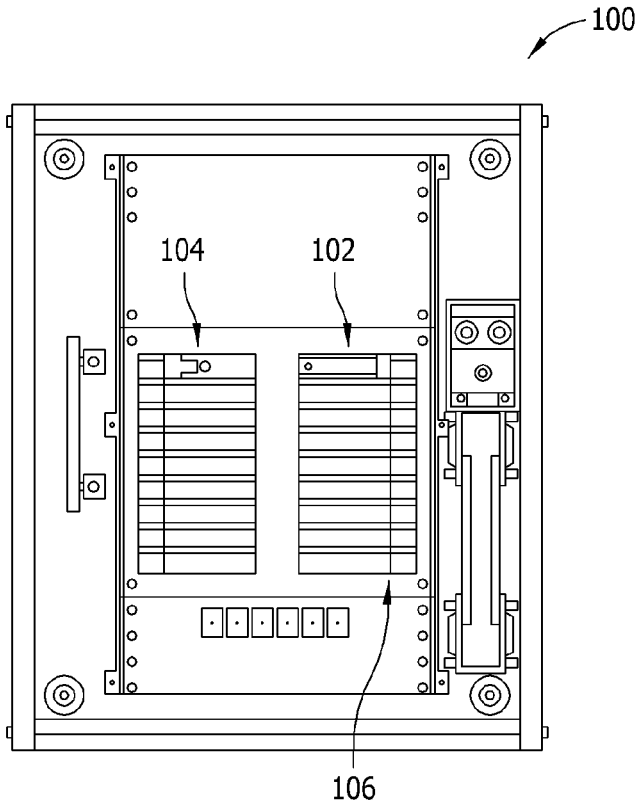
FIG. 1 is a perspective view of an exemplary fusible panelboard including a modular fuse holder.
Figure 2:
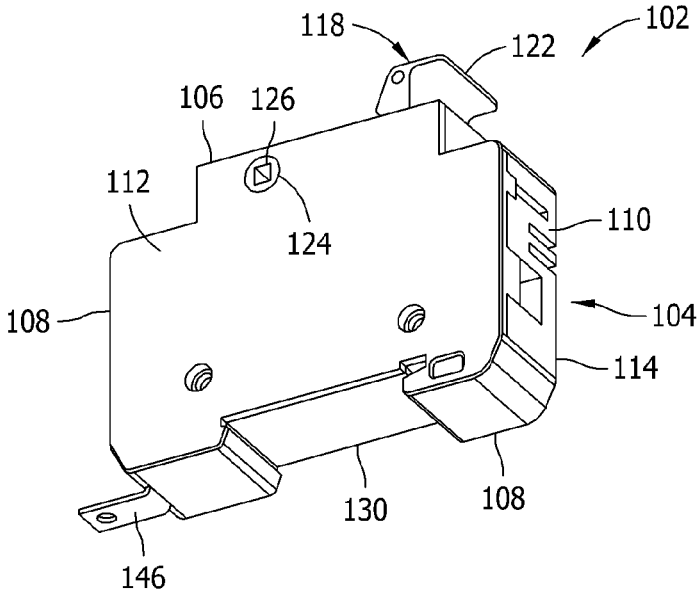
FIG. 2 is a perspective view of the fuse holder shown in FIG. 1.

FIG. 1 is a perspective view of an exemplary fusible panelboard 100 including an exemplary modular fuse holder assembly 102 described further below. The panelboard 100 is configured to accommodate a number of the fuse holder assemblies 102, and in the example shown the panelboard 100 defines two generally vertical columns, designated at 104 and 106 in FIG. 1, that each can accept nine fuse holder assemblies 102 with the fuse holder assemblies 102 arranged side-by-side one another in each row. Moreover, the panelboard 100 is adaptable, as explained in the applications referenced above, to accommodate devices other than the fuse holder assembly 102, such as fusible switch disconnect devices of various ratings and physical size. Other devices having comparable footprints and profiles may be used with the configurable panel as well. The particulars of the panelboard 100 are described in detail in the referenced applications above and will not be repeated herein.

The panelboard 100 is shown for illustrative purposes only, and the fuse holder assembly 102 accordingly may be utilized with other panelboards while achieving at least some of the benefits described below. The panelboard 100 is therefore provided in the present discussion for purposes of illustration rather than limitation.

FIGS. 2-16 illustrate various views, components and features of the exemplary fuse holder 102.

The fuse holder assembly 102 includes a nonconductive fuse holder body 104 including a top surface 106 and a bottom surface 108 opposing the top surface 106, left and right side surfaces 108 and 100 opposing one another and interconnecting the top and bottom surface 106 and 108, and lateral side surfaces 114 and 116 extending between and interconnecting the top, bottom, left and right surface 106, 108, 110 and 112.

The body 104, including the surfaces 106, 108, 110, 112, 114 and 116 collectively define an enclosure or receptacle 116 (best shown in FIGS. 11, 13 and 15) having a sufficient volume to receive a lever arm 118 and associated fuse 120 as described further below. The lever arm 118, may include a raised finger grip 122 that projects from the upper surface 106 of the fuse holder body 104. The lever arm 118 may be grasped by a user's fingers and moved between a closed position shown in FIGS. 2, 4 and 7 and an opened position shown in FIGS. 9-11, 13 and 15. In the closed position, the fuse 120 is enclosed in the body 104 in the receptacle 116, and in the open position, the receptacle 116 is exposed and the fuse 120 may be inserted into or removed from the lever arm 118. As explained below, fuse rejection features are integrated into the lever arm 118 to prevent an improper type of fuse from being installed.

In an exemplary embodiment, the body 104 and the lever arm 118 is configured to accommodate and accept a cylindrical fuse described further below. The body 104 may be formed from a nonconductive material such as plastic or another suitable material according to known techniques such as molding processes or others known in the art. In the exemplary embodiment shown, the body 104 is formed with a compact size and profile, and has an exemplary height H (FIG. 4) of about 72 mm and an exemplary width W (FIG. 4) of about 17.5 mm or less. As such, the assembly 104 may be dimensionally compliant to DIN standard 43880. The body 104 and the lever arm 118 may alternatively be dimensioned for compatibility with other types of fuses or to meet other user specified requirements.

In the embodiment shown, the lateral surface 112 includes an aperture 124 therein, and an actuator slot 126 is exposed through the surface 112 so that the lever arm 118 can be remotely actuated with a mating actuator 128 (FIG. 14) in the manner described further below.

The bottom surface 108 of the body 104 in the illustrated example is formed with a DIN rail slot 130 to facilitate mounting of the fuseholder assembly 102 for use.

First and second fuse clips 132 and 134 (FIG. 4) are mounted stationary to the body 104 within the receptacle 116. The respective first and second fuse clips 132, 134 engage corresponding first and second conductive terminal elements 136, 138 (FIGS. 5 and 6) of the fuse 120 when the fuse 120 is inserted into or received by the lever arm 118 and the lever arm 118 is in the closed position. When the lever arm 118 is moved relative to the body 104 to the opened position, the first and second fuse clips 132, 134 are disengaged from the first and second conductive terminal element 136, 138.

A line side connection terminal 140 is mechanically and electrically connected to the fuse clip 132, and a load side connection terminal 142 is mechanically and electrically connected to the second fuse clip 134. In the example shown, the line side connection terminal 140 is a panelboard clip and the load side terminal 142 is a wire lug terminal. It is appreciated, however, that a variety of alternative terminal structure is known in the art and could likewise be utilized in other embodiments. Also in the exemplary embodiment shown, the line and load side connection terminals 140, 142 each respectively define a non-switchable current path to one of the first and second fuse clips 132, 134. In other embodiments, one or more switching contacts could be associated with one of the line or load side connection terminals 140, 142 to provide a switchable current path through the fuse 120. Exemplary switching elements and arrangements are described in the applications referenced above and may be utilized in such an embodiment. Alternatively, other switching arrangements could be likewise be utilized.

Figure 3:
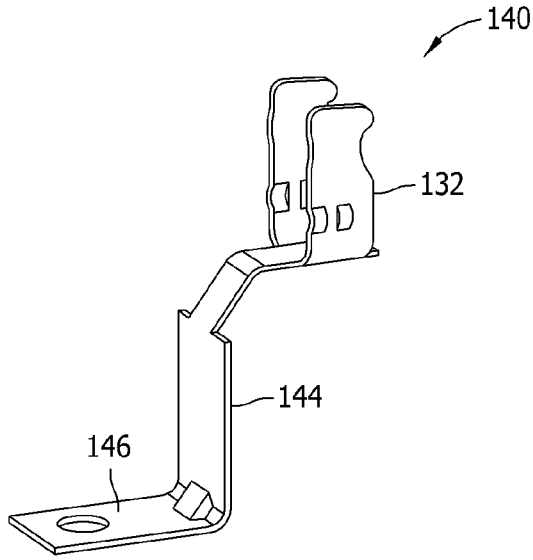
FIG. 3 is an exemplary perspective view of the panelboard clip shown in FIG. 2.
Figure 4:
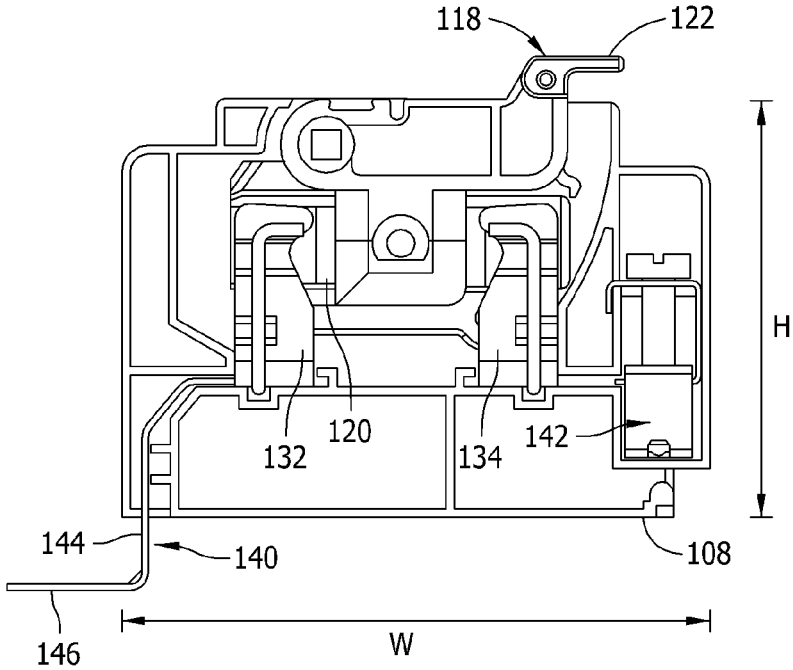
FIG. 4 is a side assembly view of the fuse holder including the panel clip.

The panelboard clip 140 extends from the bottom surface 108 (FIG. 2) of the fuse holder body 104. The panelboard clip 140 may include, as shown in FIGS. 3 and 4, a first portion 144 extending substantially perpendicularly to the bottom surface 108 of the body 104, and a second portion 146 extending substantially parallel to the bottom surface 108. The first portion 144 of the panelboard clip 140 may extend through and project from the bottom surface 108, thereby spacing the second 146 portion from the bottom surface 108. Because of this spacing, the fuseholder assembly 102 attaching the assembly 102 to the panelboard 100 (FIG. 1), or alternatively removing the assembly 102 from the panelboard 100, is simplified. Certain difficulties in installing or removing the fuse holder assembly 102, that are common to conventional fuse holders, are therefore avoided.

As shown in FIG. 3, the panelboard clip 140 is fabricated as an integral piece including the fuse clip 132 and the first and second portions 144 and 146. The panelboard clip 430 may be formed and shaped in a known manner using a suitable conductive material. By forming the fuse clip 132 integrally with the panelboard clip 140, as opposed to a separately provided panelboard clip 132 that must be connected to the fuse clip 132, reduces the parts count of the assembly and simplifies manufacturing processes. With conventional fuse holders, panel board clips tend to be separately provided parts, sometimes installed by the end user, that increase the cost of using the device and raise reliability issues if not installed properly. Also, as mentioned above, known panel clips tend to be difficult to install to a panelboard, such as the panelboard 100.

The line and load side terminals 140, 142 and the fuse clips 132, 134 may be configured such that the assembly 102 may conform to accepted standards in the industry concerning their electrical ratings and other factors. Such standards include, but are not necessarily limited to UL and IEC standards familiar to those in the industry.

Figure 5:
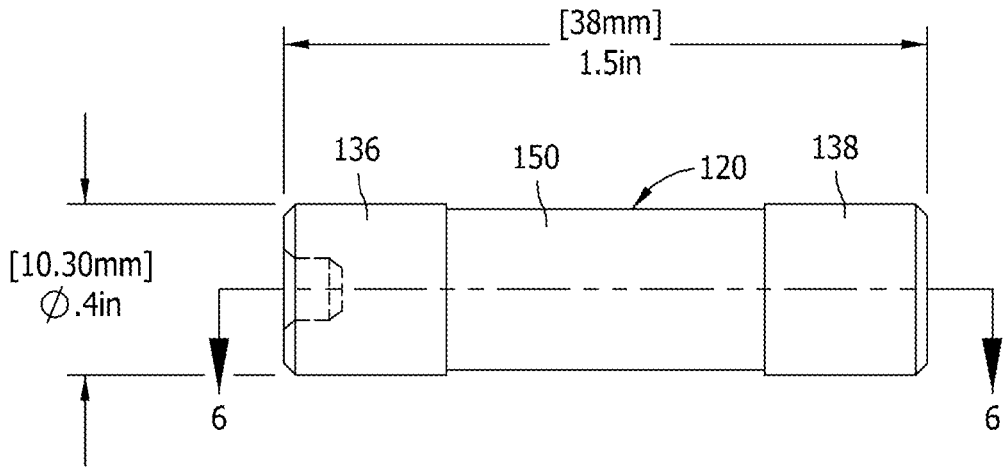
FIG. 5 is a side view of an exemplary fuse for the fuse holder shown in FIGS. 2 and 4.
Figure 6:
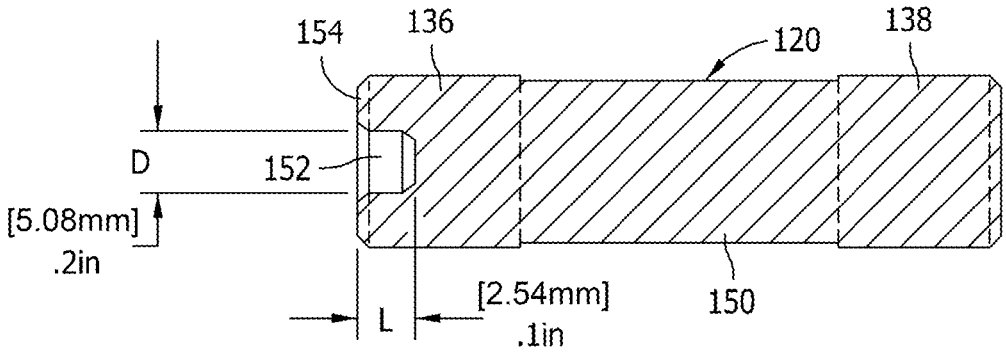
FIG. 6 is a sectional view of the fuse taken along line 6-6 in FIG. 5.

FIG. 5 is a side view and FIG. 6 is a sectional view of the exemplary fuse 120 for the fuse holder assembly 120 in the exemplary embodiment shown. The fuse 120 includes a generally cylindrical fuse body 150 and conductive terminal elements 136, 138 attached to the opposing ends of the body 150. The body 150 may be fabricated from a suitable nonconductive material known in the art according to known processes. The terminal elements 136, 138 may be provided in the form of conductive ferrules as shown. The ferrules may be attached to the body 150 in any known manner.

One or more fusible links or elements (not shown), or a fuse element assembly, is contained within the body 150 and connected between the fuse terminal elements 136, 138 so that when electrical current through the fuse 120 exceeds a predetermined limit, the fusible elements melt and open the circuit path through the fuse 120.

As such, when the fuse 120 is installed in the fuseholder assembly 102, the fusible element or elements that extend between the fuse terminals 136, 138 define a conductive current path for current to flow between the fuse clips 132, 134, and in turn completes a circuit path between the line and load side terminals 140, 142 of the assembly 102. When the fusible element or elements operate in response to specified current conditions, however, no current is conducted between the fuse terminal elements 136, 138 and the line side terminal 146 becomes electrically isolated from the load side terminal 142. The fuse 120 must then be replaced to restore operation of the circuitry.

The fuse 120 may be a photovoltaic fuse attachable to the panelboard 100 as part of a power distribution system in a solar powered electrical network. In different embodiments, the fuse 120 may more specifically be a UL248-xx or IEC 60269-2-1 photovoltaic fuse having an operating voltage of about 1000 Vdc, an amperage rating of about 1 A to about 32

A, and an interrupting rating of about 33 kA. In the example shown in FIGS. 5 and 6, the fuse terminal element 136 includes an inwardly extending indention or depression 152 arranged on an axial centerline of the fuse 120. The depression 152 extends centrally on an end face 154 of the terminal element 136, and in one example, the depression 152 is a substantially cylindrical cavity having a length L of about 0.1 inches (2.54 mm) and a diameter D of about 0.2 inches (5.84 mm).

Because of operating differences in solar powered systems versus other power distribution networks, it is important the photovoltaic fuse 120 not be replaced with another and generally incompatible type of fuse. Because different types of fuses, however, can be relatively easily confused this presents practical concern to system administrators. The consequences of having a mismatched fuse installed in the fuse holder assembly 102 can be significant. Accordingly, the assembly 102 includes features to prevent this from happening.

Turning now to FIGS. 7-11, it will be seen that the lever arm 118 is configured to reject an incompatible fuse. More specifically, in the exemplary embodiment shown the lever arm 118 defines an open faced axial sleeve 155 dimensioned to receive and support the fuse 120. The sleeve 155 includes an abutment surface 156 for the cylindrical fuse 120 and a fuse rejection stub 158 projecting therefrom. The stub 158 is substantially aligned with the longitudinal axis of the fuse 120 when the fuse 120 is received in the sleeve, and the stub 158 is complementary in shape and dimension to the depression 152 of the fuse terminal element 136.

Figure 7:
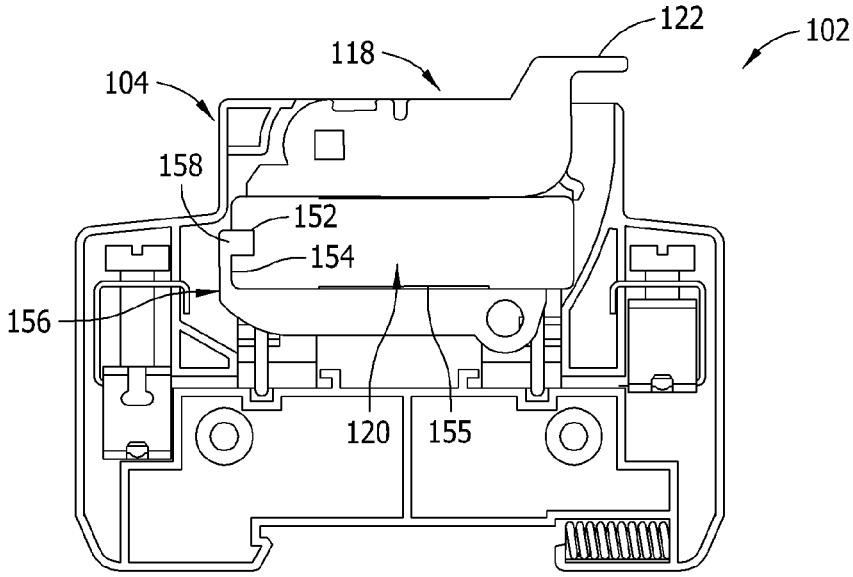
FIG. 7 is a side schematic view of the fuse holder shown in FIG. 2 including the fuse shown in FIGS. 5 and 6.
Figure 8:
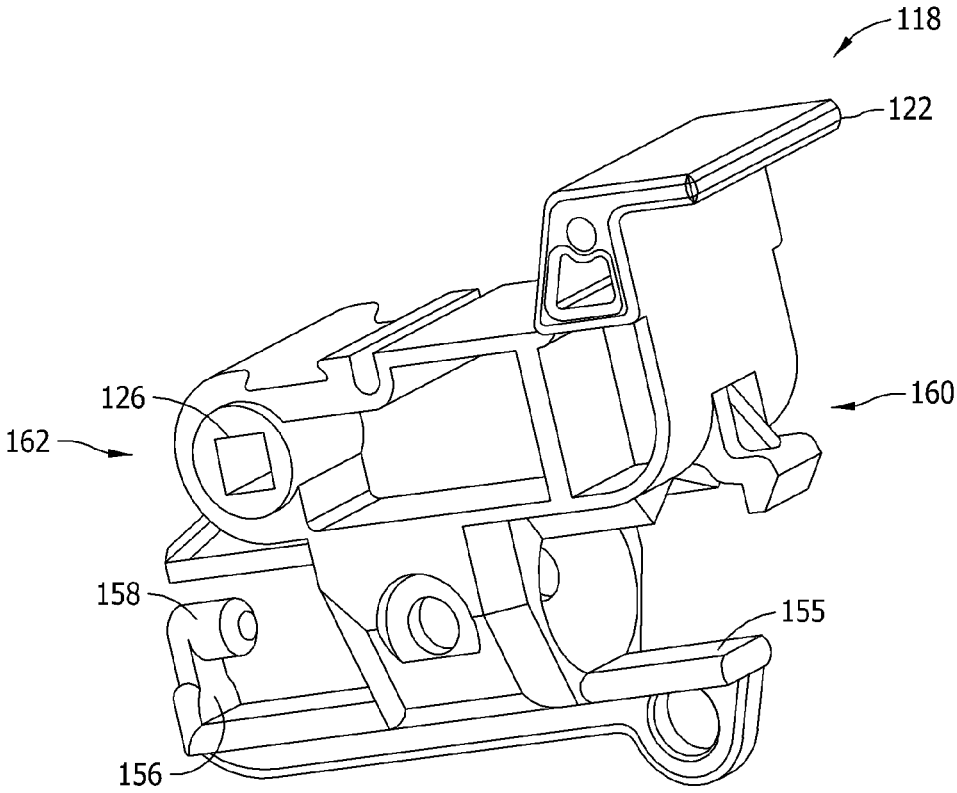
FIG. 8 is a perspective view of a lever arm for the fuse holder shown in FIG. 5.

When the fuse 120 is inserted into the sleeve 155, the stub 158 may be received in the depression 152 in the fuse terminal element 136 and the end face 154 (FIG. 6) of the fuse terminal element 158 may be positioned in abutting contact with the abutment surface 156 of the sleeve 155 as shown in FIG. 7. The axial length of the sleeve 155 is about the same as the axial length of the fuse 120 so that the lever arm 118 can be moved to the closed position.

The lever arm 118 in the illustrated embodiment is an integrally formed or single piece element including the sleeve 155, the actuator slot 126, and other features described herein. The lever arm 118 may be fabricated from plastic according to known techniques.

The lever arm 118 includes generally opposed first and second ends 160 and 162. The end 160 defines the finger grip 122 and the open face of the sleeve 155. The end 162 is rotatably mounted to the fuse holder body 104 proximate the top surface 106 (FIG. 2) via the projecting actuator slot 156 formed in the end 162. The actuator slot 156 is situated in and exposed through the aperture 214 (FIG. 2) in the side surface 112. The lever arm 118 is accordingly pivotal about the end 162 such that the end 160 is selectively positionable to place the lever arm 118 in the open position and the closed position relative to the fuse holder body 104 as described above. The open position provides access to insert or remove the 120 fuse from the lever arm 118 and the closed position prevents access to the fuse 120 within the fuse holder body 104. A degree of safety is therefore provided that some conventional fuse holders do not provide.

As still another enhancement, the lever arm 118 may be configured with an audible click feature so that a user can know if the arm 118 is completely closed. Such an audible click feature can be implemented in a variety of ways and is believed to be within the purview of those in the art.

Figure 9:
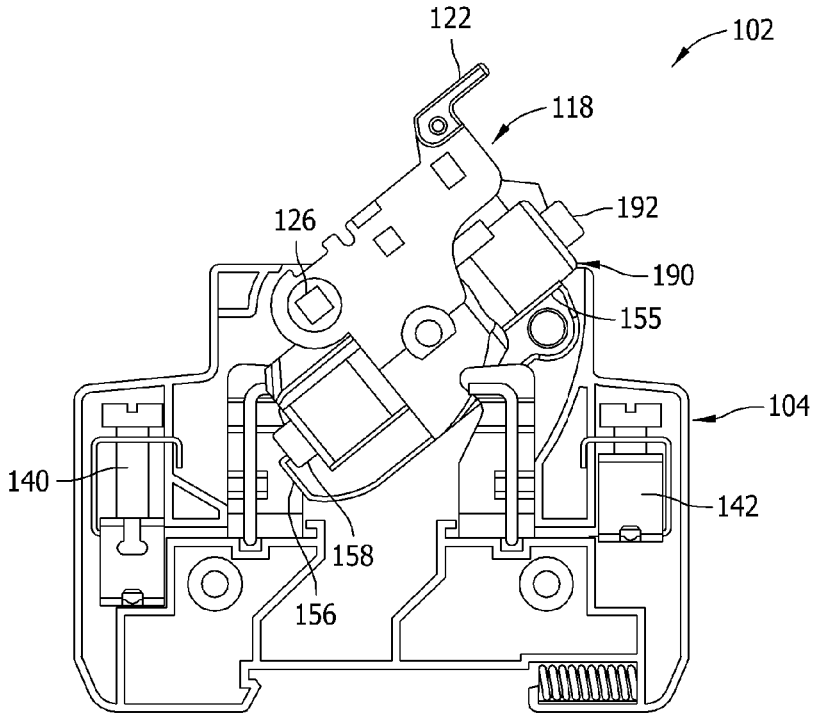
FIG. 9 illustrates the lever arm rejecting a first type of fuse in the fuse holder.

FIG. 9 illustrates the lever arm 118 in the open position, but with an improper fuse received in the sleeve 155. Specifically, the lever arm 118 is shown in FIG. 9 with a Class CC fuse 190 that, instead of including the depression 152 (FIG. 6) in one of its terminal elements, actually includes a projection 192. The stub 158 interferes with the abutting terminal element at one end of the fuse 190 because the fuse does not include the depression 152, and the projection 192 extends beyond the sleeve 155 at the other end. As a result, the fuse 190 cannot be completely received in the sleeve 155. The projection 192 of the fuse 190 consequently interferes with the body 104 and frustrates any attempt to move the lever arm 118 to the closed position. As such, it can be practically assured that a user cannot mistakenly replace the proper fuse 120 with the improper fuse 190 and still complete an electrical connection through the assembly 102.

It may also be shown in FIG. 9 that the panelboard clip 140 (FIG. 4) on the line side has been replaced by another box lug terminal 142. The assembly 102 may accordingly be used apart from the panelboard 100 if desired.

Figure 10:
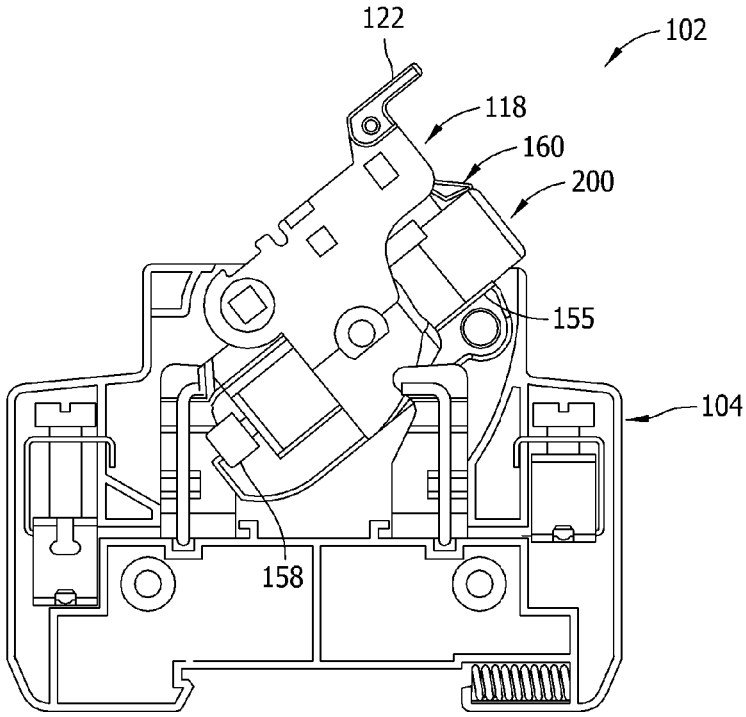
FIG. 10 illustrates the lever arm rejecting a second type of fuse in the fuse holder.

FIG. 10 illustrates the lever arm 118 in the open position, but with another improper fuse received in the sleeve 155. Specifically, the lever arm 118 shown in FIG. 10 is shown with fuse 200 such as a UL Supplemental fuse or IEC 10x38 fuse that can be placed in the sleeve 155, but because the fuse 200 does not include the depression 152 (FIG. 6) of the proper fuse 120, the stub 158 interferes with the abutting terminal element when the fuse 200 is inserted into the sleeve 155. Because of this interference, the fuse 200 cannot be completely received in the sleeve 155 and the portion of the fuse 200 at the end 160 projects from the sleeve 155. The projecting portion of the fuse 200, in turn, interferes with the body 104 and frustrates any attempt to move the lever arm 118 to the closed position. As such, it can be practically assured that a user cannot mistakenly replace the proper fuse 120 with the improper fuse 200 and still complete an electrical connection through the assembly 102.

Figure 11:
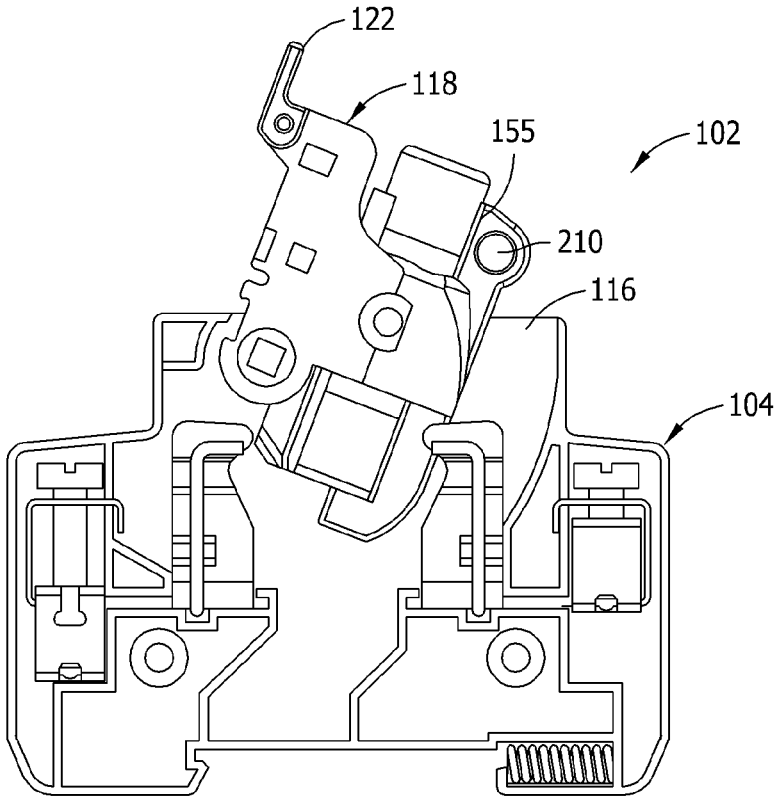
FIG. 11 illustrates a shank lock feature for the lever arm in the fuse holder.

FIG. 11 illustrates the lever arm 118 in the open position wherein fuses can be inserted or removed from the sleeve 155, and also showing a shank lock opening 210 formed just below the sleeve 155 at the end 160 of the lever arm 118. The opening 210 may receive the shank of a padlock, for example, and the assembly 102 may accordingly be locked with the lever arm 118 in the open position while the load side circuitry or components are serviced. When the lock is removed, the lever arm 118 can again be closed and the circuit completed through the fuse.

Figure 12:
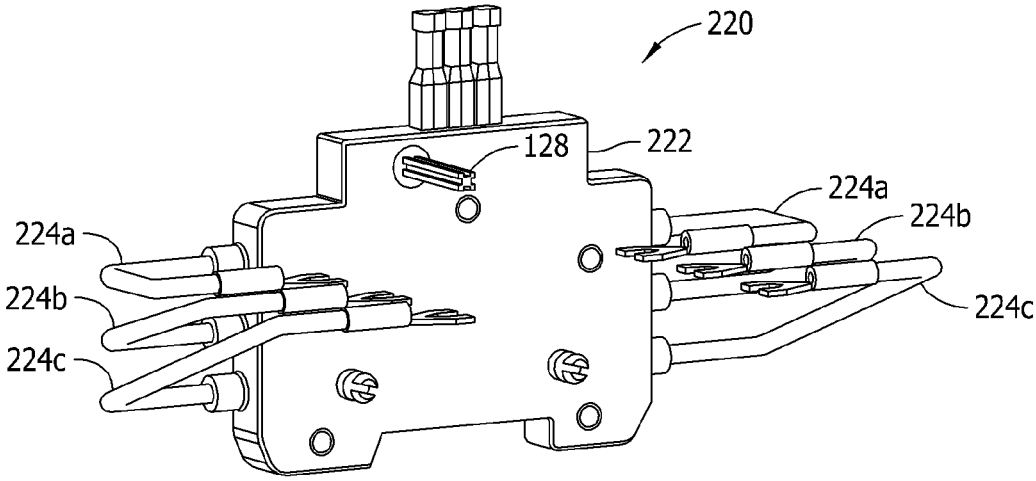
FIG. 12 illustrates a monitoring accessory for the fuse holder.
Figure 13:
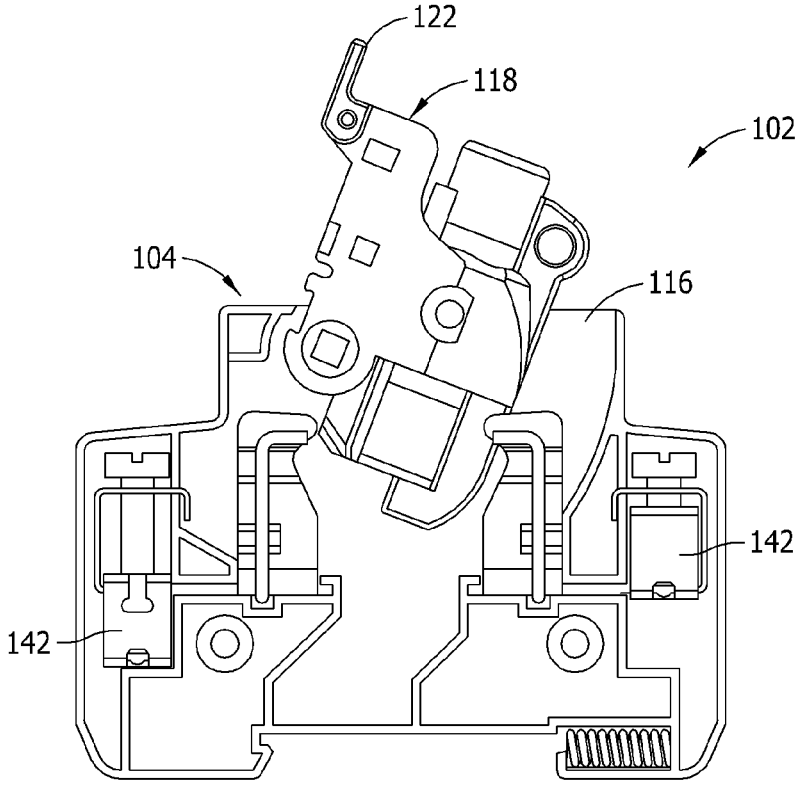
FIG. 13 illustrates an actuator slot for the lever arm.
Figure 14:
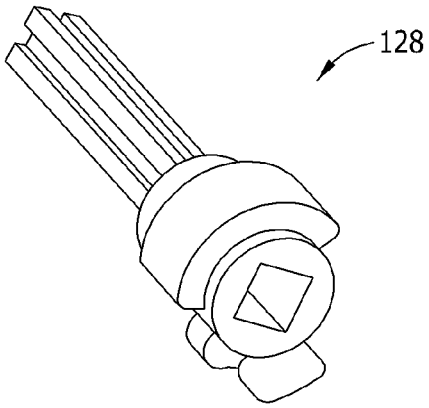
FIG. 14 illustrates an actuator for the slot shown in FIG. 13.
Figure 15:
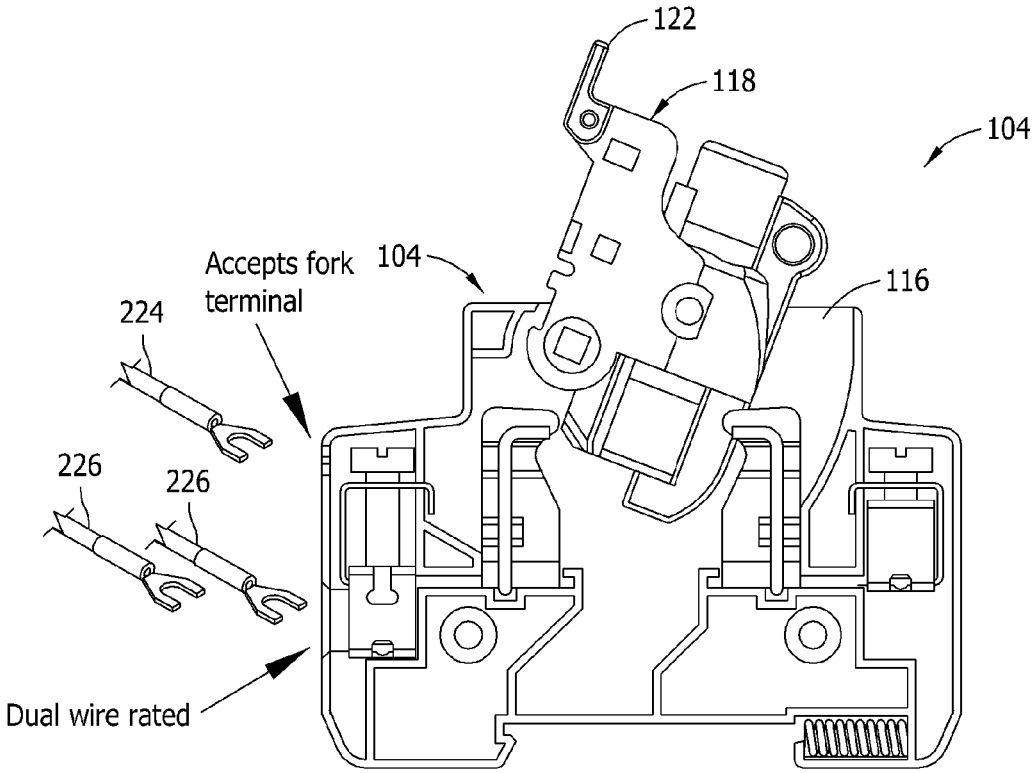
FIG. 15 illustrates an exemplary terminal lug feature for the fuse holder.

FIG. 12 illustrates a monitoring accessory 220 for the fuse holder 102. The accessory 220 is provided as a status module that is separately provided from the fuse holder assembly 202, and is configured to transmit a signal to a remote device when the fuse 120 operates to open a current path between the first and second fuse clips 132, 134 as described above. More specifically, the accessory 220 includes a body 222 having sensors therein, and external wire conductors 224*a*, 224*b*, 224*c* each configured for connection in parallel to one of the fuses 120. For example, the line and load side terminals 142 (FIG. 13) may be dual wire lug terminals that can each accept one of the conductor wires 224 (FIG. 14) for monitoring purposes, and one or more line side or load side connecting wires 226.

The sensors in the housing, via the wires 224, are connected in parallel with the fuse 120 in the assembly 102 and may monitor voltage conditions, for example, across the fuse. When the fusible element operates and the fuse opens, the voltage drop is detected and a signal may be sent from the accessory 220 to a remote location to indicate the open fuse.

In the embodiment shown in FIG. 11, three sets of wire conductors 224 are provided and the accessory 220 therefore is capable of monitoring three different modular fuse holder assemblies 102, and hence can independently monitor three different fuses 120 associated with the assemblies 102. The accessory 220 may be mounted to the panelboard 100 (FIG. 1) alongside the fuse holder assemblies 102 or may be used with fuse holder assemblies 102 apart from the panelboard 100.

Particulars of the monitoring assembly 220 are described in detail in U.S. Pat. No. 7,576,630, the disclosure of which is hereby incorporated by reference in its entirety.

The actuator 128 (also shown in FIG. 14) may be attached to and extend from the accessory 220 such that the accessory 220 can not only monitor the fuses in fuse holder assemblies 102, but also drive the lever arms 118 in the assembly 102 to the opened or closed positions. Proactive management of the power distribution system is therefore possible as the pivot arms 118 can be opened or closed from remote locations in response to operating conditions and disturbances, or to facilitate maintenance of the system. When the actuator 128 is coupled to the actuator slot 126 (FIG. 2), rotation of the actuator 128 causes rotation of the actuator slot 126, and the lever arm 118 is accordingly opened or closed. Reset features may also be included in the accessory 220 so that the lever arm 118 can be manually opened without triggering the accessory 220 to signal an opened fuse condition to a remote location.

The benefits of the invention are now believed to have been amply illustrated in connection with the exemplary embodiments disclosed.

An embodiment of a fuse holder assembly has been disclosed including: a nonconductive fuse holder body defining a fuse receptacle, the fuse holder body including a top surface and a side surface including an aperture; a lever arm adapted to receive and retain a cylindrical fuse having first and second conductive terminal elements, the lever arm including opposing first and second ends, the first end being rotatably mounted to the fuse holder body proximate the top surface and a portion of the first end being exposed and accessible through the aperture in the side surface, the lever arm being pivotal about the first end such that the second end is selectively positionable between an open position and a closed position relative to the fuse holder body, the open position providing access to insert or remove the cylindrical fuse from the lever arm and the closed position preventing access to the cylindrical fuse; first and second fuse clips mounted to said body, wherein the respective first and second fuse clips engage the first and second conductive terminal elements when the cylindrical fuse is received therein and the lever arm is in the closed position, and wherein the first and second fuse clips are disengaged from the first and second conductive terminal elements when the cylindrical fuse is received in the lever arm and the lever arm is in the open position; and line and load side connection terminals each associated with one of the first and second fuse clips, the line and load side connection terminals each respectively defining a non-switchable current path to one of the first and second fuse clips.

Optionally, one of the line and load side connection terminals may be a panelboard clip extending from the fuse holder body. The fuse holder body may include a bottom surface opposite the top surface, and the panelboard clip may include a first portion extending substantially perpendicularly to the bottom surface and a second portion extending substantially parallel to the bottom surface. The first portion of the fuse clip may extend through and project from the bottom surface, thereby spacing the second portion from the bottom surface. The panelboard clip may be integrally formed with one of the first and second fuse clips. The fuse holder assembly may further include a panelboard, with the panelboard clip attachable to the panelboard.

The lever arm may be configured to reject an incompatible fuse, including a UL Supplemental fuse, a class CC fuse, and an IEC 10x38 fuse. The lever arm may define an axial sleeve configured to receive the fuse, with the sleeve including an abutment surface for the cylindrical fuse and a fuse rejection stub projecting therefrom. The stub may be substantially aligned with a longitudinal axis of the cylindrical fuse when the fuse is received in the sleeve. One of the first and second conductive terminal elements of the cylindrical fuse may include an indentation, with the stub being received in the indentation. The fuse may be a photovoltaic fuse.

A portion of the first end of the lever arm may define an actuator slot, with the actuator slot being exposed and accessible through the aperture in the side surface. The lever arm may optionally define a shank lock opening at the second end.

A status module may optionally be separately provided from the nonconductive body and configured to transmit a signal to a remote device when the cylindrical fuse operates to open a current path between the first and second fuse clips. The status module may be configured to simultaneously monitor multiple cylindrical fuses. The status module may include an actuator coupled to an actuator slot of the fuse holder assembly, whereby when the actuator slot is rotated as the lever arm is opened, the actuator is also rotated and causes the status module to be reset.

At least one of the line and load side connection terminals may optionally include a dual wire box lug terminal. An audible tactile click may be associated with one of the opened and closed positions of the lever arm. A height of the fuse holder may be less than about 72 mm. A width of the fuse holder may be about 17.5 mm or less.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse holder assembly comprising:

a nonconductive fuse holder body defining a fuse receptacle, the fuse holder body including a top surface and a side surface including an aperture;

a lever arm adapted to receive and retain a cylindrical fuse having first and second conductive terminal elements, the lever arm including opposing first and second ends, the first end being rotatably mounted to the fuse holder body proximate the top surface and a portion of the first end being exposed and accessible through the aperture in the side surface, the lever arm being pivotal about the first end such that the second end is selectively positionable between an open position and a closed position relative to the fuse holder body, the open position providing access to insert or remove the cylindrical fuse from the lever arm and the closed position preventing access to the cylindrical fuse;

first and second fuse clips mounted to said body, wherein the respective first and second fuse clips engage the first and second conductive terminal elements when the cylindrical fuse is received therein and the lever arm is in the closed position, and wherein the first and second fuse clips are disengaged from the first and second conductive terminal elements when the cylindrical fuse is received in the lever arm and the lever arm is in the open position; and line and load side connection terminals each associated with one of the first and second fuse clips, the line and load side connection terminals each respectively defining a non-switchable current path to one of the first and second fuse clips.

2. The fuse holder assembly of claim 1, wherein one of the line and load side connection terminals comprises a panelboard clip extending from the fuse holder body.

3. The fuse holder assembly of claim 2, wherein the fuse holder body includes a bottom surface opposite the top surface, and the panelboard clip includes a first portion extending substantially perpendicularly to the bottom surface and a second portion extending substantially parallel to the bottom surface.

4. The fuse holder assembly of claim 3, wherein the first portion of the fuse clip extends through and projects from the bottom surface, thereby spacing the second portion from the bottom surface.

5. The fuse holder assembly of claim 2, wherein the panelboard clip is integrally formed with one of the first and second fuse clips.

6. The fuse holder assembly of claim 2, further comprising a panelboard, the panelboard clip attachable to the panelboard.

7. The fuse holder assembly of claim 1, wherein the lever arm is configured to reject an incompatible fuse.

8. The fuse holder assembly of claim 7, wherein the lever arm defines an axial sleeve configured to receive the fuse, the sleeve including an abutment surface for the cylindrical fuse and a fuse rejection stub projecting therefrom.

9. The fuse holder assembly of claim 8, wherein the stub is substantially aligned with a longitudinal axis of the cylindrical fuse when the fuse is received in the sleeve.

10. The fuse holder assembly of claim 9, wherein one of the first and second conductive terminal elements of the cylindrical fuse includes an indentation, the stub being received in the indentation.

11. The fuse holder assembly of claim 10, wherein the fuse is a photovoltaic fuse.

12. The fuse holder assembly of claim 1, wherein the lever arm defines a shank lock opening at the second end.

13. The fuse holder assembly of claim 1, further comprising a status module separately provided from the nonconductive body and configured to transmit a signal to a remote device when the cylindrical fuse operates to open a current path between the first and second fuse clips.

14. The fuse holder assembly of claim 13, wherein the status module is configured to simultaneously monitor multiple cylindrical fuses.

15. The fuse holder assembly of claim 13, wherein the portion of the first end being exposed and accessible through the aperture in the side surface includes an actuator slot, and the status module includes an actuator coupled to the actuator slot, whereby when the actuator slot is rotated as the lever arm is opened, the actuator is also rotated and causes the status module to be reset.

16. The fuse holder assembly of claim 1, wherein at least one of the line and load side connection terminals comprises a dual wire box lug terminal.

17. The fuse holder assembly of claim 1, wherein an audible tactile click is associated with one of the opened and closed positions.

18. The fuse holder assembly of claim 1, wherein a height of the fuse holder body is less than about 72 mm.

19. The fuse holder assembly of claim 18, wherein a width of the fuse holder is about 17.5 mm or less.

20. The fuse holder assembly of claim 1, wherein the lever arm is configured to reject a UL supplemental fuse, a class CC fuse, and an IEC 10×38 fuse.

21. The fuse holder assembly of claim 1, wherein the portion of the first end of the lever arm defines an actuator slot, the actuator slot being exposed and accessible through the aperture in the side surface.

22. The fuse holder assembly of claim 21, further comprising an actuator configured to connect to the slot.

23. A fuse holder assembly comprising:

a nonconductive fuse holder body defining a fuse receptacle;

a lever arm adapted to receive and retain a cylindrical fuse having first and second conductive terminal elements, the lever arm including opposing first and second ends, the first end being rotatably mounted to the fuse holder body proximate the top surface, the lever arm being pivotal about the first end such that the second end is selectively positionable between an open position and a closed position relative to the fuse holder body, the open position providing access to insert or remove the cylindrical fuse from the lever arm and the closed position preventing access to the cylindrical fuse;

first and second fuse clips mounted to said body, wherein the respective first and second fuse clips engage the first and second conductive terminal elements when the cylindrical fuse is received therein and the lever arm is in the closed position, and wherein the first and second fuse clips are disengaged from the first and second conductive terminal elements when the cylindrical fuse is received in the lever arm and the lever arm is in the open position; and line and load side connection terminals each associated with one of the first and second fuse clips, the line and load side connection terminals each respectively defining a non-switchable current path to one of the first and second fuse clips, wherein one of the line and load side connection terminals comprises a panelboard clip extending from the fuse holder body, wherein the fuse holder body includes a top surface and a side surface having an aperture, and wherein a portion of the first end of the lever arm is exposed and accessible through the aperture in the side surface.

24. The fuse holder assembly of claim 23, wherein one of the line and load side connection terminals comprises a box lug terminal.

* * * * *